US005422465A

United States Patent [19]

Kim et al.

[11] Patent Number: 5,422,465

[45] Date of Patent: Jun. 6, 1995

[54] APPARATUS FOR AND METHOD OF AUTOMATICALLY HEATING FOODS IN MICROWAVE OVEN

[75] Inventors: Jae M. Kim; Jeong T. Kim; Byeong W. Park, all of Kyungki-Do; Woo J. Yang, Seoul, all of Rep. of Korea

[73] Assignee: Goldstar Co., Ltd., Seoul, Rep. of Korea

[21] Appl. No.: 181,310

[22] Filed: Jan. 13, 1994

[30] Foreign Application Priority Data

Jan. 13, 1993 [KR] Rep. of Korea ..... 361/1993
Jan. 19, 1993 [KR] Rep. of Korea ..... 580/1993
Jan. 19, 1993 [KR] Rep. of Korea ..... 581/1993

[51] Int. Cl.[6] ..... H05B 6/68

[52] U.S. Cl. ..... 219/710; 219/708; 219/707; 219/705

[58] Field of Search ..... 219/705, 710, 711, 707, 219/708, 757

[56] References Cited

U.S. PATENT DOCUMENTS 4,336,433 6/1982 Yokozeki ..... 219/707
4,481,394 11/1984 Tanabe ..... 219/707
4,894,502 1/1990 Oh ..... 219/710
4,918,276 4/1990 Oh ..... 219/710

FOREIGN PATENT DOCUMENTS 491619 6/1992 European Pat. Off. ..... 219/710

*Primary Examiner*—Philip H. Leung

[57] ABSTRACT

An apparatus for and a method of automatically heating foods in a microwave oven, capable of heating foods at an optimum state even when foods are to be continuously heated, by determining an ambient temperature from a variation in temperature of air introduced in a heating chamber through an air inlet port, determining a temperature increment in a heating chamber of the microwave oven and an amount of food, based on the determined ambient temperature, determining a primary heating time and an additional heating time, based on the determined temperature increment, and then determining an additional heating time, based on the determined food amount. As a result, it is possible to achieve an improvement in cooking performance. In addition, over-heating of the good is avoided, thereby enabling a reduction in electric power consumption and a reduction in cooking time.

4 Claims, 6 Drawing Sheets

APPARATUS FOR AND METHOD OF AUTOMATICALLY HEATING FOODS IN MICROWAVE OVEN

BACKGROUND OF THE INVENTION

1. Field of the Invention

The present invention relates to a microwave oven, and more particularly to an apparatus for and a method of automatically heating foods in a microwave oven.

2. Description of the Prior Art

As shown in FIG. 1, a microwave oven of the general type having an automatic heating function comprises a microprocessor 1 for controlling the microwave oven, a power supply unit 2 for supplying electric power to the microwave oven, and a magnetron 3 for generating electronic waves by the electric power supplied from the power supply unit 2. In the microwave oven, a heating chamber 4 is provided for receiving the electronic waves from the magnetron 3 and heating a food by the received electronic waves. The heating chamber 4 has an air inlet port 4A and an air outlet port 4B. The microwave oven further comprises a fan 5 for introducing air in the heating chamber 4A through the air inlet port 4A, a pair of temperature sensors 6A and 6B respectively disposed around the air inlet port 4A and the air outlet port 4B and adapted to sense the temperature of air introduced in the heating chamber 4 and the temperature of air exhausted from the heating chamber 4, and a pair of A/D converter units 7A and 7B for converting the temperatures sensed by the temperature sensors 6A and 6B into digital signals and then sending them to the microprocessor 1, respectively.

Now, operation of the microwave oven having an automatic heating function will be described, in conjunction with FIGS. 2 to 4.

When a cooking start button is pressed by a user under a condition that food to be cooked has been put in the heating chamber 4, a select signal corresponding to the cooking start button is sent to the microprocessor 1 so as to start automatic cooking of the food.

Based on the select signal, the microprocessor 1 generates a control signal by which the fan 5 is, in turn, driven for a predetermined time t1 to introduce air in the heating chamber 4 via the air inlet port 4A.

When a temperature equilibrium is obtained in the heating chamber 4 by the lapse of the predetermined time t1, respective temperatures V1 and U1 around the air outlet port 4B and the air inlet port 4A are detected by the temperature sensors 6B and 6A. Based on the detected temperature U1 around the air inlet port 4A, a temperature increment ΔTA in the heating chamber 4 is determined.

In other words, the temperature increment ΔTA in the heating chamber 4 is determined by subtracting the detected temperature U1 from a predetermined reference temperature R to derive an error E between the temperature U1 and the reference temperature R, dividing the derived error E by a general constant F experimentally derived, multiplying the resultant value by a temperature increment ΔT to derive a value δ, and then adding the temperature increment ΔT to the value δ.

The temperature increment ΔTA can be expressed by the following equation:

$$\Delta TA = \Delta T + \Delta T(R - U1)/F$$

wherein, ΔT represents a temperature increment in the heating chamber 4 under a condition that no error occurs.

The temperature increment ΔTA determined in the above-mentioned manner is sent to and then stored in the microprocessor 1.

Thereafter, the magnetron 3 is driven in accordance with a control signal generated from the microprocessor 1 so as to primarily heat the food contained in the heating chamber 4.

During the heating operation, the temperature detected around the air outlet port 4B by the temperature sensor 6B is increased to a temperature V2. When a variation in the air outlet port temperature reaches the temperature increment ΔTA, that is, when the difference between the current temperature V2 and the initial temperature V1 is higher than the temperature increment ΔTA (V2−V1>ΔTA), an additional heating time t3 is then determined by multiplying a time t2 taken for the current temperature V2 of the air outlet port 4A to reach ambient temperature by a predetermined weight a. Thereafter, the food is heated for the determined additional heating time t3.

In other words, the magnetron 3 and the fan 5 are driven for the determined additional heating time t3 to heat the food. After the additional heating time t3 has elapsed, the magnetron 3 and the fan 5 are stopped to complete the heating of the food.

As mentioned above, the temperature increment ΔTA is determined, based on the error E occurring by the temperature U1 of air introduced in the heating chamber 4 through the air inlet port 4A. Accordingly, the temperature increment ΔTA is constant, irrespective of the season.

The additional food heating time t3 is irrespective of the load, namely, the amount of food, because it is determined by multiplying the time t2 taken for the temperature variation in the heating chamber 4 to reach the determined temperature increment ΔTA by the predetermined weight a. In other words, where the amount of food is large, the heating operation is stopped before the cooking of food is completed. As a result, the food may be underdone. Where the amount of food is small, the food may be overdone.

Referring to FIG. 4, there are shown variations in parameters determining the food heating time, that is, variations in temperature increment ΔTA1, ΔTA2, the temperature of the air inlet port 4A and the temperature of the air outlet port 4B. As apparent from FIG. 4, the ambient temperature is approximately constant irrespective of the heating of food. However, the temperature of the air inlet port 4A is gently increased during the heating of food and then sharply increased due to the remaining heat of the magnetron 3 when the heating of food is completed. On the other hand, the temperature of the air outlet port 4B is sharply increased simultaneously with the heating of food and sharply decreased simultaneously with the completion of the heating of food.

Where foods are continuously cooked in the conventional microwave oven having the above-mentioned construction, an execution of a cooking under a condition that the heating chamber has been heated due to an immediately prior cooking causes the magnetron not to operate for a certain time. This causes a problem in that the temperature increment in the heating chamber for cooking is inaccurately calculated because the temperature of the air inlet port is sharply varied during the stoppage period of the magnetron, for example, corresponding to about 3 minutes after the magnetron is stopped while the temperature of the air outlet port is approximately constant during the same period.

SUMMARY OF THE INVENTION

Therefore, an object of the invention is to provide an apparatus for and a method of automatically heating food in a microwave oven, capable of achieving an optimum cooking by determining a temperature increment in a heating chamber of the microwave oven, based on an ambient temperature determined by correcting a variation in temperature of air introduced in a heating chamber of the microwave oven depending on the season.

Another object of the invention is to provide an apparatus for and a method of automatically heating a food in a microwave oven, capable of achieving optimum cooking by determining an additional heating time, based on the amount of food.

Another object of the invention is to provide an apparatus for and a method of automatically heating a food in a microwave oven, capable of achieving optimum cooking where foods are continuously cooked in the microwave oven, by determining a temperature increment in a heating chamber of the microwave oven for each food, based on both an ambient temperature determined by correcting a variation in temperature of air introduced in a heating chamber of the microwave oven depending on the season and a stoppage time of a magnetron of the microwave oven.

In accordance with one aspect, the present invention provides a method of automatically heating foods in a microwave oven, comprising the steps of: (a) detecting the temperature of air initially introduced in a heating chamber of said microwave oven through an air inlet port as an initial temperature; (b) detecting the temperature of air introduced in said heating chamber through said air inlet port as a current temperature after a predetermined time has elapsed; (c) calculating an ambient temperature from said temperatures detected at said steps (a) and (b), said ambient temperature being corrected depending on the season; (d) calculating a temperature increment in the heating chamber from said ambient temperature; (e) calculating an amount of food from the time taken in obtaining said temperature increment and determining an additional food heating time, based on said calculated food amount; (f) heating the food for said additional heating time determined at said step (e) and then completing the cooking of the food; and (g) checking a stoppage time of a magnetron of the microwave oven after the completion of the cooking, correcting said temperature increment in accordance with said stoppage time, and executing the above procedures again when the stoppage time has been checked to be not less than a predetermined time.

In accordance with another aspect, the present invention provides an apparatus for automatically heating foods in a microwave oven, comprising: a microprocessor for controlling said microwave oven; a power supply unit for supplying an electric power to the microwave oven; a magnetron for generating microwaves by said electric power supplied from said power supply unit; a heating chamber for receiving the microwaves from said magnetron and heating a food by said received microwaves, said heating chamber having an air inlet port and an air outlet port; a fan for introducing an air in the heating chamber through said air inlet port; a pair of temperature sensors respectively disposed around the air inlet port and the air outlet port and adapted to detect the temperature of said air introduced in the heating chamber and the temperature of air exhausted from the heating chamber; a pair of A/D converter units for converting said temperatures detected by said temperature sensors into digital signals and then for sending them to said microprocessor, respectively; a comparing unit for comparing the temperature increment detected by the temperature sensors with a temperature increment predetermined in accordance with the amount of food to determine whether said detected temperature increment has reached said predetermined temperature increment; a load determining unit for detecting the amount of food from an output signal of said comparing unit; a stoppage counter for counting a stoppage time of the magnetron; and a temperature increment compensating unit for determining a temperature increment corresponding to said stoppage time counted by said stoppage counter and determining a primary heating time and an additional heating time, based on said determined temperature increment.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

Figure 5:
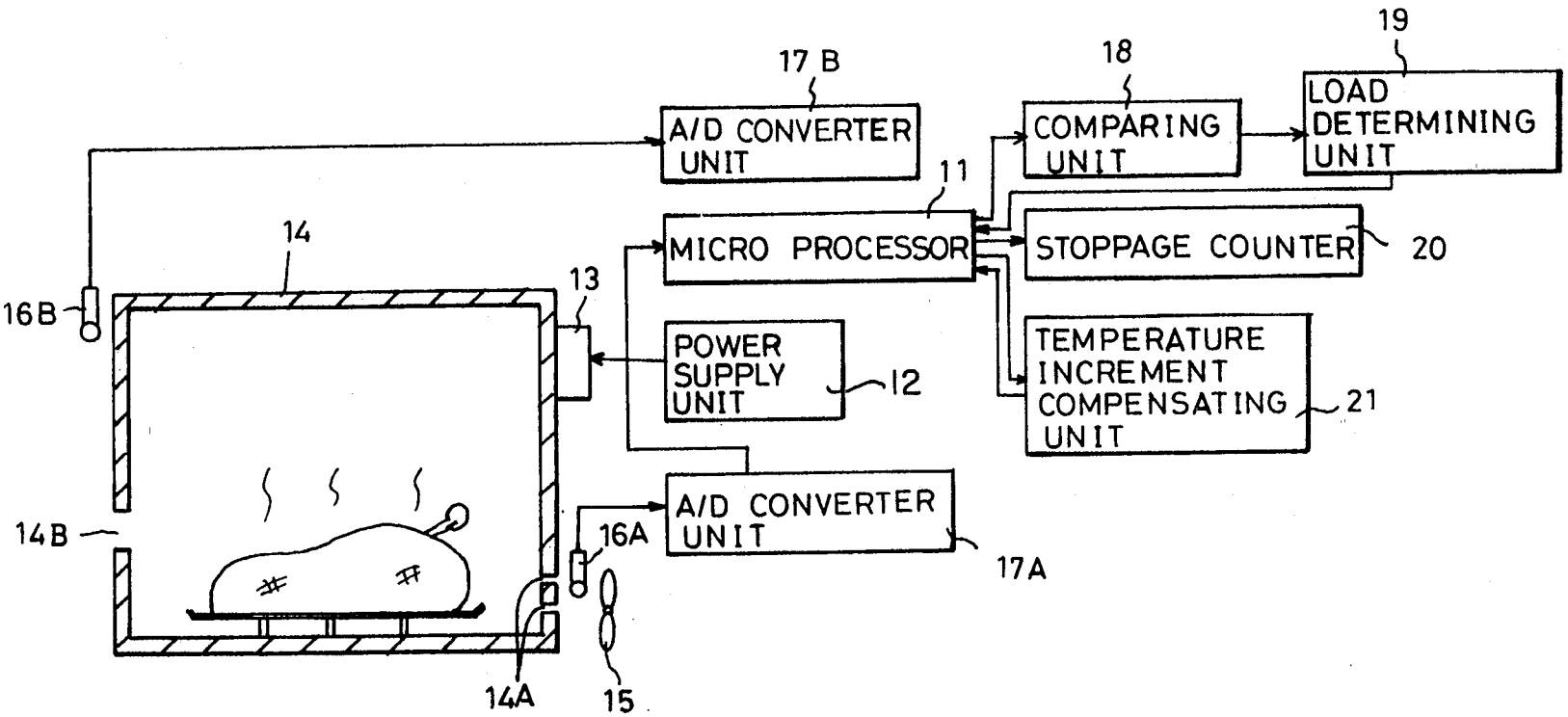
FIG. 5 is a block diagram of an apparatus for automatically heating a food in a microwave oven in accordance with the present invention.

Referring to FIG. 5, there is illustrated an apparatus for automatically heating food in a microwave oven in accordance with the present invention.

As shown in FIG. 5, the apparatus comprises a microprocessor 11 for controlling the microwave oven, a power supply unit 12 for supplying electric power to the microwave oven, and a magnetron 13 for generating microwaves by the electric power supplied from the power supply unit 12. In the microwave oven, a heating chamber 14 is provided for receiving the microwaves from the magnetron 13 and heating food by the received microwaves. The heating chamber 14 has an air inlet port 14A and an air outlet port 14B. The apparatus further comprises a fan 15 for introducing air in the heating chamber 14A through the air inlet port 14A, a pair of temperature sensors 16A and 16B respectively disposed around the air inlet port 14A and the air outlet port 14B and adapted to sense the temperature of air introduced in the heating chamber 14 and the temperature of air exhausted from the heating chamber 14, and a pair of A/D converter units 17A and 17B for converting the temperatures sensed by the temperature sensors 16A and 16B into digital signals and for sending them to the microprocessor 11, respectively. Furthermore, the apparatus comprises a comparing unit 18 for comparing a temperature increment detected by the temperature sensors 16A and 16B with a temperature increment predetermined in accordance with an amount of food to determine whether the detected temperature increment has reached the predetermined temperature increment, a load determining unit 19 for detecting the amount of food from an output signal of the comparing unit 18, a stoppage counter 20 for counting a stoppage time of the magnetron 13, and a temperature increment compensating unit 21 for determining a temperature increment corresponding to a counted value of the stoppage counter 20 and for determining a primary heating time and an additional heating time, based on the determined temperature increment.

Figure 6A:
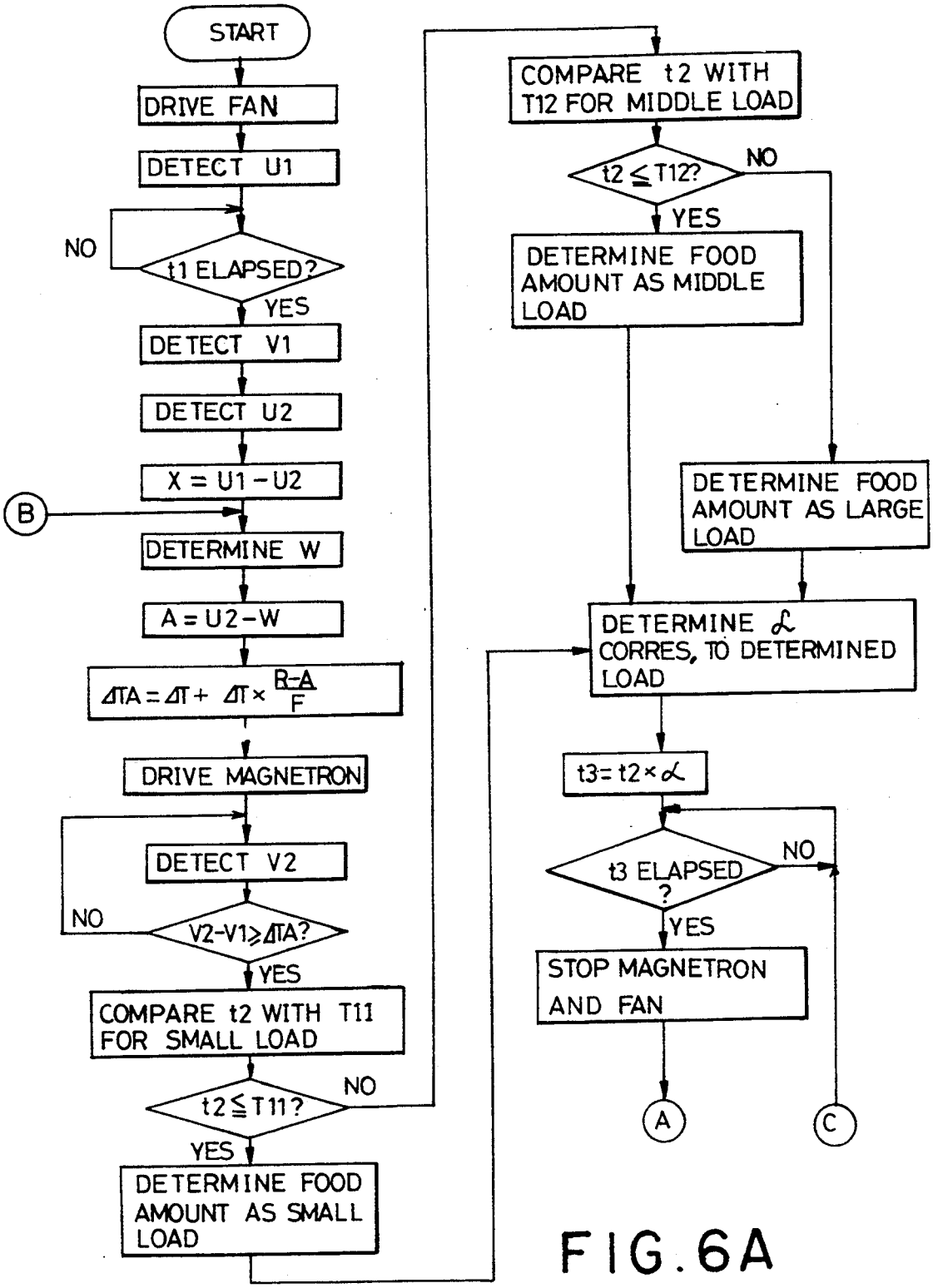
FIGS. 6A and 6B are flow charts respectively illustrating an automatic food heating procedure performed in the microwave oven in accordance with the present invention.

Now, a food heating operation of the heating apparatus of the microwave oven in accordance with the present invention will be described, in conjunction with FIGS. 5 to 6B.

When a cooking start button is pressed by the user under a condition that the food to be cooked has been put in the heating chamber 14, a select signal corresponding to the cooking start button is sent to the microprocessor 11 so as to start automatic cooking of the food.

Based on the select signal, the microprocessor 11 generates a control signal by which the fan 15 is, in turn, driven for a predetermined time t1 to introduce warm air into the heating chamber 14 via the air inlet port 14A.

When a temperature equilibrium is obtained in the heating chamber 14 by the lapse of the predetermined time t1, respective temperatures V1 and U1 around the air outlet port 14B and the air inlet port 14A are detected by the temperature sensors 16B and 16A. The detected temperatures V1 and U1 are respectively applied to the A/D converter units 17A and 17B and then converted into digital signals which are, in turn, applied to the microprocessor 11.

The temperatures V1 and U1 received in the microprocessor 11 are independently stored. Thereafter, an ambient temperature A is determined, based on a variation in temperature at the air inlet port 14A.

Based on the determined ambient temperature, a temperature increment ΔTA in the heating chamber 14 is then determined. The ambient temperature A is closely related to both the season and the temperature of air introduced in the heating chamber 14 through the air inlet port 14A.

In accordance with the present invention, the ambient temperature A is determined by subtracting the current temperature U2 of air currently introduced in the heating chamber 14 through the air inlet port 14A from the initial temperature U1 of air initially introduced in the heating chamber 14 to derive a temperature deviation X, determining a temperature error W experimentally predetermined, based on the temperature deviation X, and then subtracting the determined temperature error W from the current temperature U2.

Figure 1:
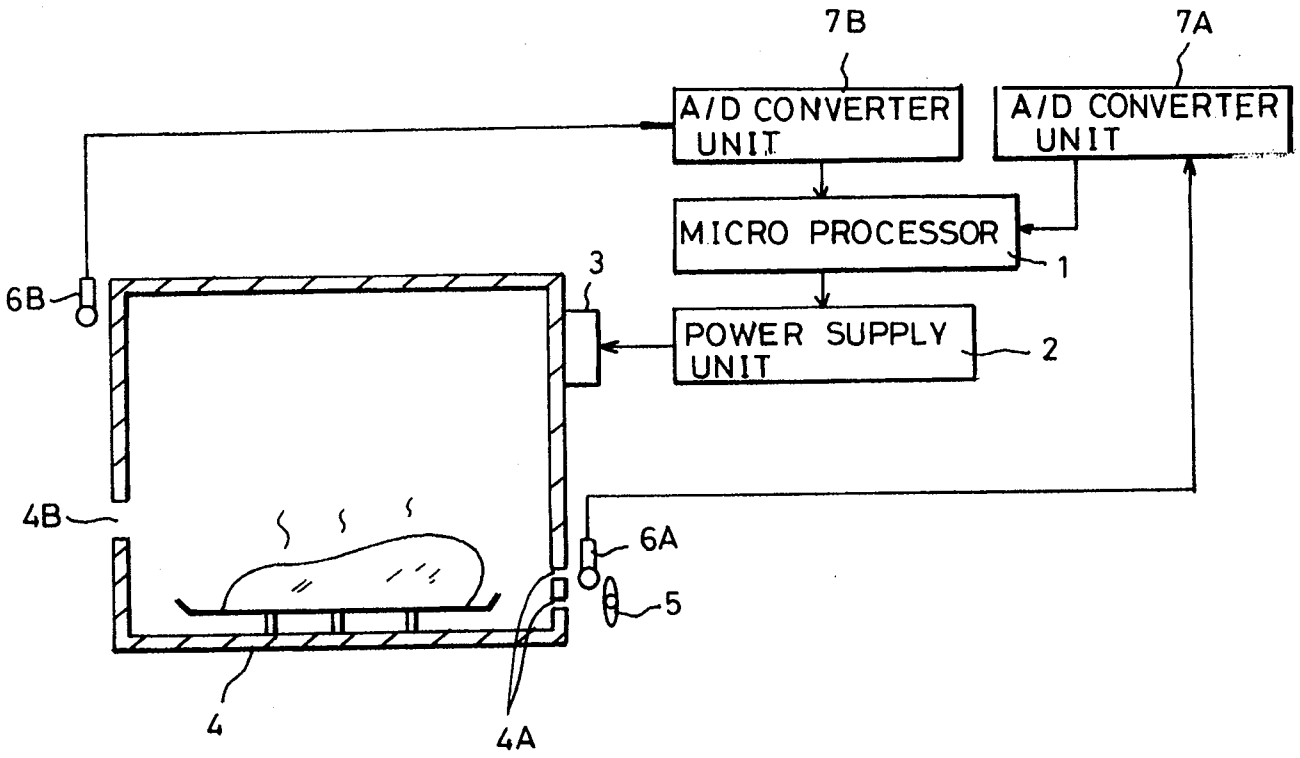
FIG.1 (PRIOR ART)
FIG. 1 is a block diagram of a conventional microwave oven having an automatic heating function.
Figure 2:
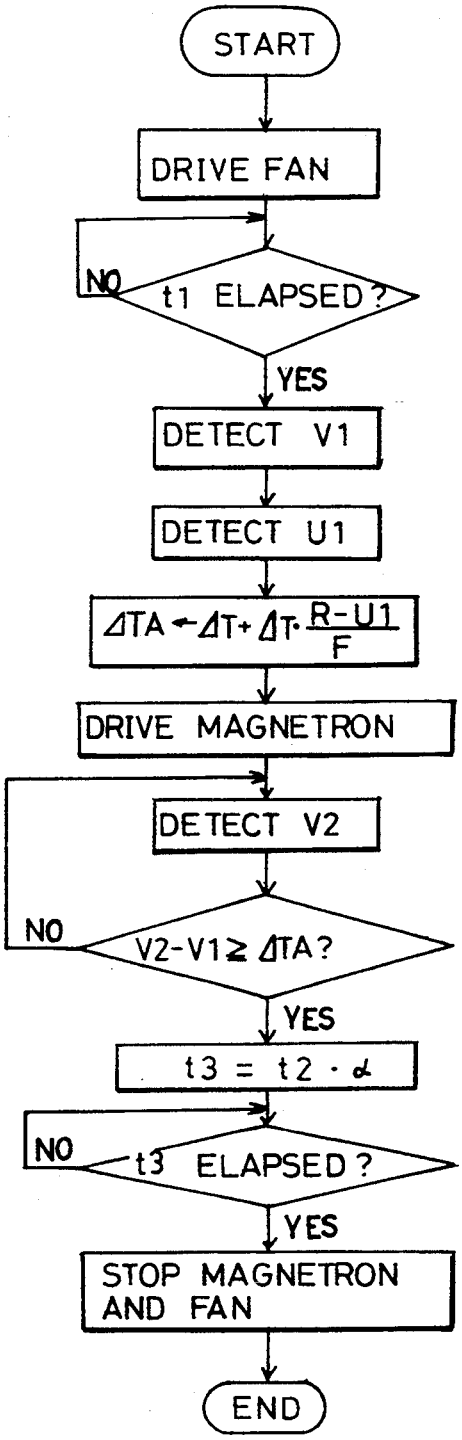
FIG.2 (PRIOR ART)
FIG. 2 is a flow chart illustrating an automatic food heating procedure performed in the conventional microwave oven.
Figure 3:
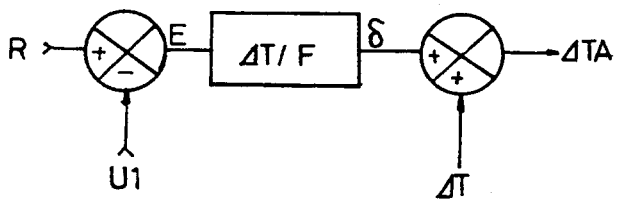
FIG. 3 (PRIOR ART)
FIG. 3 is a block diagram illustrating a procedure of determining a temperature increment with error corrected performed in the conventional microwave oven.
Figure 4:
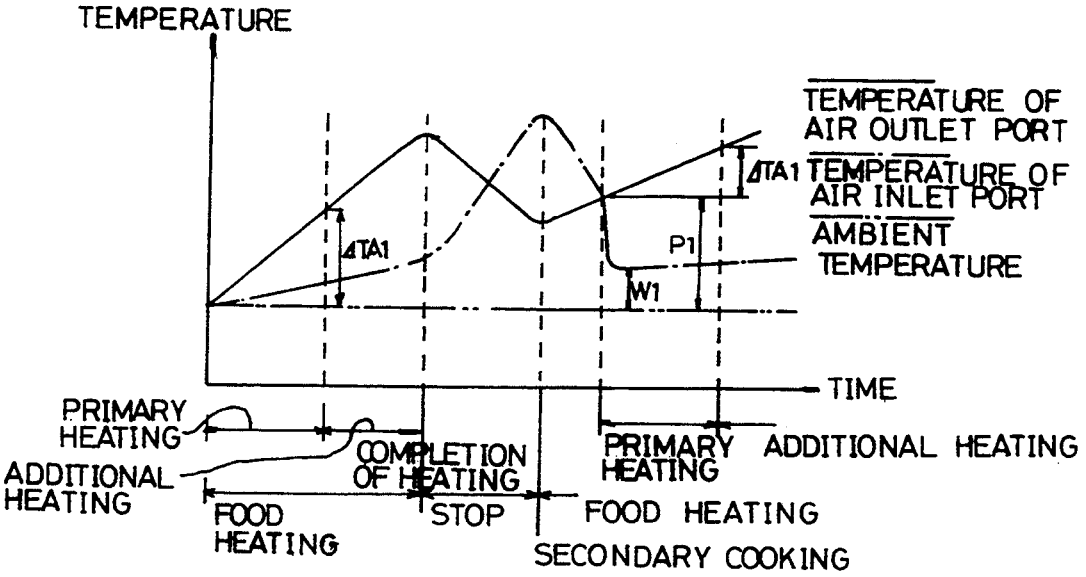
FIG. 4 (PRIOR ART)
FIG. 4 is a graph illustrating variations in air temperatures detected around an air inlet port and an air outlet port in the conventional microwave oven.

As shown in FIG. 3, the temperature increment ΔTA in the heating chamber 4 is also determined by subtracting the inflow air $U_1$ initially detected from a predetermined reference temperature R to derive an error E between the ambient temperature $U_1$ and the reference temperature R, dividing the derived error E by a general constant F experimentally derived, multiplying the resultant value by a temperature increment ΔT to derive a value δ, and then adding the temperature increment ΔT to the value δ. That is, the temperature increment ΔTA is predetermined, based on the ambient temperature corrected depending on the season.

The temperature increment ΔTA can be expressed by the following equation:

$$\Delta TA = \Delta T + \Delta T(R\text{-}U1)/F$$

wherein, ΔT represents a temperature increment in the heating chamber 14 under a condition that no error occurs.

The temperature increment ΔTA determined in the above-mentioned manner is sent to and then stored in the microprocessor 11. Thereafter, the magnetron 13 is driven in accordance with a control signal generated from the microprocessor 11 so as to primarily heat the food contained in the heating chamber 14.

During the heating operation, the temperature V2 currently detected around the air outlet port 14B by the temperature sensor 16B is increased. When a variation in the air outlet port temperature reaches the predetermined temperature increment ΔTA, that is, when the difference between the current temperature V2 and the initial temperature V1 is higher than the predetermined temperature increment ΔTA (V2−V1>ΔTA), a determination is then made about a time t2 taken for a variation in the temperature of the air outlet port 4A to reach the predetermined temperature increment ΔTA.

Based on the time t2, the amount of food to be heated is then determined. For this determination, the comparing unit 18 compares the time t2 with a predetermined limit time T11 for a small load. When the time t2 is not more than the predetermined limit time t11, the comparing unit 18 applies a corresponding signal to the load determining unit 19 which, in turn, determines the amount of food as a small load, based on the received signal.

When the time t2 is more than the predetermined limit time t11, the comparing unit 18 compares a predetermined limit time T12 for a middle load. When the time t2 is not more than the predetermined limit time t12, the comparing unit 18 applies a corresponding signal to the load determining unit 19 which, in turn, determines the amount of food as a middle load, based on the received signal.

When the time t2 is more than the predetermined limit time t12, the comparing unit 18 applies a corresponding signal to the load determining unit 19 which, in turn, determines the amount of food as a large load, based on the received signal.

Thereafter, an additional heating time t3 is determined by multiplying the time t2 by a weight factor a predetermined depending on the determined amount of food. Thereafter, the food is heated for the determined additional heating time t3.

In other words, the magnetron 13 and the fan 15 are driven for the determined additional heating time t3 to heat the food. After the additional heating time t3 has elapsed, the magnetron 13 and the fan 15 are stopped to complete the heating of the food.

Where foods are continuously cooked in the microwave oven, an execution of a cooking under a condition that the heating chamber has been heated due to a just previous cooking causes the magnetron not to operate for a certain time. During such a stoppage time of the magnetron, the temperature of air exhausted from the heating chamber 14 through the air outlet port 14B is approximately constant. However, the temperature of air introduced in the heating chamber 14 through the air inlet port 14A is greatly varied during the stoppage time of the magnetron 13.

To this end, the stoppage counter 20 is operated by a control signal generated from the microprocessor 11 to count the stoppage time of the magnetron 13. Based on the result of the counting, the increment of the ambient temperature is varied.

For example, where a cooking start button signal is inputted when the stoppage counter 20 counts a time not more than 2 minutes, a deviation in the temperature of air introduced in the heating chamber 14 through the air inlet port 14A is derived by subtracting the current temperature U2 (detected at every time interval of 8 seconds by the temperature sensor 16A) from the initial temperature U1, multiplying the resultant value by a constant value K1, and then adding the difference between the initial temperature U1 and the current temperature U2 to the resultant product.

This temperature deviation X can be expressed by the following equation:

$$X=(U1-U2)K1+(U1-U2)$$

Figure 6B:
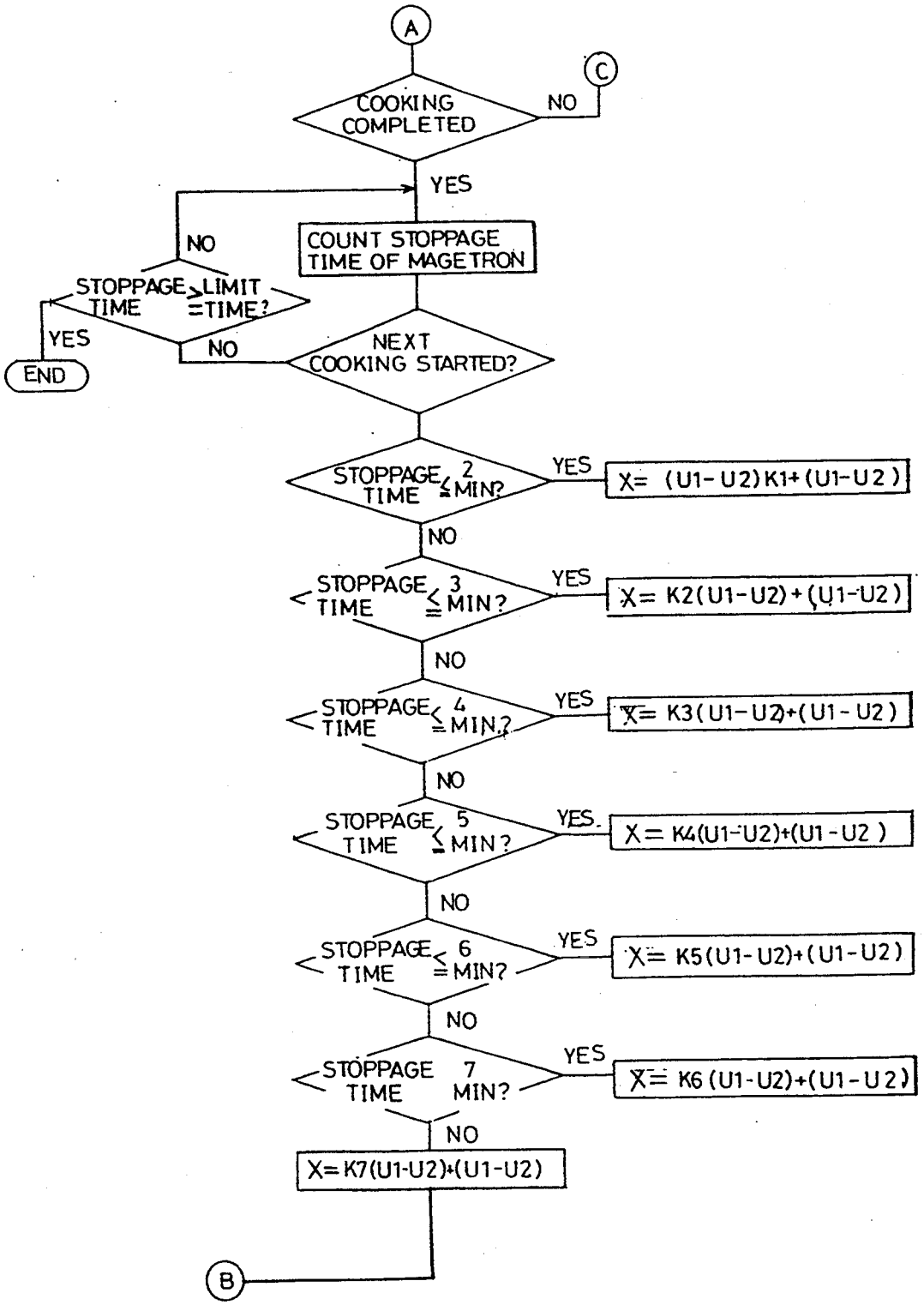

In the illustrated case, the stoppage time is checked for every minute within 8 minutes, as shown in FIG. 6B.

The temperature deviation X derived in the above-mentioned manner is used for determining a temperature error W, experimentally predetermined. The determined temperature error W is then subtracted from the current temperature U2 to determine the ambient temperature A.

Based on the ambient temperature A, the temperature increment ΔTA in the heating chamber and the amount of food are determined. Also, a primary heating time t1 is determined from the temperature increment ΔTA. Based on the amount of food, the additional heating time is determined. The procedure of heating the food is carried out in the same manner as described above.

As apparent from the above description, the present invention provides an apparatus for and a method of automatically heating foods in a microwave oven, capable of heating foods at an optimum state even when foods are to be continuously heated, by determining an ambient temperature from a variation in temperature of air introduced in a heating chamber through an air inlet port, determining a temperature increment in a heating chamber of the microwave oven and an amount of food, based on the determined ambient temperature, determining a primary heating time, based on the determined temperature increment, and then determining an additional heating time based on the determined food amount. As a result, it is possible to achieve an improvement in cooking performance. In addition, an over-heating of food is avoided, thereby enabling a reduction in electric power consumption and a reduction in cooking time.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method of automatically heating foods in a microwave oven, comprising the steps of:

(a) detecting the initial temperature, $U_1$, of air introduced into a heating chamber of said microwave oven through an air inlet port;

(b) detecting the current temperature of said air after a predetermined time, t1, has elapsed where t1 is the time needed for the temperature in the heating chamber to reach equilibrium;

(c) calculating an ambient temperature, A, from said temperatures detected at said steps (a) and (b), said ambient temperature, A, being corrected depending on the season by (1) subtracting said initial temperature, $U_1$ from said current temperature to derive a temperature deviation; and (2) determining a temperature error experimentally derived by season corresponding to said temperature deviation derived at said step (c-1), and then subtracting said determined temperature error from the current temperature to determine said ambient temperature, A, (d) calculating a temperature increment, ΔTA, from said ambient temperature according to the equation:

ΔTA=ΔT+ΔT(R-A)/F, where ΔT, R and F are determined experimentally in accordance with the kind and amount of food to be cooked, (e) calculating an amount of food from the time needed for the difference of temperatures of outflow air initially and currently detected to be greater than the compensated temperature increment and determining an additional food heating time, based on said calculated food amount;

(f) heating the food for said additional heating time determined at said step (e) and then completing the cooking of the food.

2. A method in accordance with claim 1, further comprising the steps of:

(g) comparing a stoppage time of a magnetron between the current cooking and the consecutive cooking with a limit time and ending the cooking operation when the stoppage time is longer than the limit time;

(h) calculating the temperature deviation of air introduced in a heating chamber when the stoppage time is shorter than the limit time; and (i) executing the procedures again from step (c) to step (f) of claim 1 with the temperature deviation calculated at step (h).

3. A method in accordance with claim 1, wherein said step (e) comprises the steps of:

(e-1) determining said time taken for a variation in temperature of an air exhausted from said heating chamber via an air outlet port to reach said temperature increment;

(e-2) determining said amount of food to be heated as a small load when said time is not more than a predetermined limit time for said small load, as a middle load when the time is more than said predetermined limit time for the small load, but not more than a predetermined limit time for said middle load, and as a large load when the time is more than said predetermined limit time for the middle load; and (e-3) multiplying the time by a weight predetermined depending on the amount of food determined at said step (e-2) to determine said additional heating time.

4. An apparatus for automatically heating foods in a microwave oven, comprising:

a microprocessor means for controlling said microwave oven;

a power supply unit means for supplying electric power to the microwave oven;

a magnetron means for generating microwaves by said electric power supplied from said power supply unit;

a heating chamber means for receiving the microwaves from said magnetron means and heating a food by said received microwaves, said heating chamber means having an air inlet port and an air outlet port;

a fan means for introducing air into the heating chamber through said air inlet port;

a pair of temperature sensors means, respectively disposed around the air inlet port and the air outlet port, for detecting a temperature of said air introduced in the heating chamber and a temperature of an air exhausted from the heating chamber;

a pair of A/D converter means for converting said temperatures detected by said temperature sensors into digital signals and then sending them to said microprocessor, respectively;

comparing unit means for comparing predetermined time limits with the time required for the difference of temperatures of outflow air initially and currently detected to be greater than a compensated temperature increment;

load determining means for determining from an output signal of said comparing unit the amount of food to be cooked;

stoppage counter means for counting the idle time of the magnetron between current and consecutive cookings; and temperature increment compensating means for determining a temperature increment corresponding to said stoppage time counted by said stoppage counter and for determining a primary heating time and an additional heating time, based on said determined temperature increment.

* * * * *